US009335050B2

(12) United States Patent
Cunha et al.

(10) Patent No.: US 9,335,050 B2
(45) Date of Patent: May 10, 2016

(54) GAS TURBINE ENGINE COMBUSTOR

(71) Applicants: Frank J. Cunha, Avon, CT (US); Nurhak Erbas-Sen, Manchester, CT (US)

(72) Inventors: Frank J. Cunha, Avon, CT (US); Nurhak Erbas-Sen, Manchester, CT (US)

(73) Assignee: United Technologies Corporation, Farmington, CT (US)

( * ) Notice: Subject to any disclaimer, the term of this patent is extended or adjusted under 35 U.S.C. 154(b) by 541 days.

(21) Appl. No.: 13/627,688

(22) Filed: Sep. 26, 2012

(65) Prior Publication Data

US 2014/0083100 A1 Mar. 27, 2014

(51) Int. Cl.

| | |
|---|---|
| ***F02C 7/22*** | (2006.01) |
| ***F23R 3/28*** | (2006.01) |
| ***F23R 3/14*** | (2006.01) |
| *F23R 3/34* | (2006.01) |

(52) U.S. Cl.

CPC .. *F23R 3/14* (2013.01); *F23R 3/286* (2013.01)

(58) Field of Classification Search

CPC ..... F02C 7/22; F23R 3/28; F23R 3/30; F23R 3/14; F23R 3/286; F23R 3/34; F23D 14/00

USPC ..... 60/737, 748, 747; 239/5; 431/284

See application file for complete search history.

(56) References Cited

U.S. PATENT DOCUMENTS

| | | | | |
|---|---|---|---|---|
| 3,433,015 | A | 3/1969 | Sneeden | |
| 4,653,279 | A | 3/1987 | Reynolds | |
| 5,113,648 | A | 5/1992 | Shekleton et al. | |
| 5,121,597 | A * | 6/1992 | Urushidani | F02C 7/26 60/733 |
| 5,131,221 | A | 7/1992 | Shekleton | |
| 5,220,795 | A | 6/1993 | Dodds et al. | |
| 5,239,818 | A | 8/1993 | Stickles et al. | |
| 5,261,223 | A | 11/1993 | Foltz | |
| 5,505,045 | A | 4/1996 | Lee et al. | |
| 5,640,841 | A * | 6/1997 | Crosby | F02C 7/264 219/121.54 |
| 5,735,681 | A | 4/1998 | Cheng | |
| 5,879,148 | A | 3/1999 | Cheng et al. | |
| 5,899,074 | A * | 5/1999 | Komatsu | F23D 23/00 60/39.21 |
| 5,997,595 | A | 12/1999 | Yokohama et al. | |
| 6,101,814 | A | 8/2000 | Hoke et al. | |
| 6,105,372 | A | 8/2000 | Mandai et al. | |
| 6,205,789 | B1 | 3/2001 | Patterson et al. | |
| 6,247,310 | B1 | 6/2001 | Norris et al. | |
| 6,354,072 | B1 | 3/2002 | Hura | |
| 6,363,726 | B1 | 4/2002 | Durbin et al. | |
| 6,405,523 | B1 * | 6/2002 | Foust | F23R 3/14 60/748 |
| 6,408,629 | B1 | 6/2002 | Harris et al. | |

(Continued)

FOREIGN PATENT DOCUMENTS

| | | |
|---|---|---|
| DE | 102010020389 | 11/2011 |
| DE | 102010021997 | 12/2011 |

(Continued)

OTHER PUBLICATIONS

EP search report for EP13842463.5 dated Mar. 4, 2016.

*Primary Examiner* — Ehud Gartenberg
*Assistant Examiner* — Filippo Manfredi
(74) *Attorney, Agent, or Firm* — O'Shea Getz P.C.

(57) ABSTRACT

A swirler assembly for a gas turbine engine includes an outer annular injector which at least partially surrounds an inner injector. In sonic embodiments, a combustor section for a gas turbine engine comprises an inner injector which defines an axis, an outer annular injector which surrounds said inner injector, and a combustor vane along said axis.

19 Claims, 13 Drawing Sheets

(56) References Cited

U.S. PATENT DOCUMENTS

| | | | |
|---|---|---|---|
| 6,513,331 | B1 | 2/2003 | Brown et al. |
| 6,536,207 | B1 | 3/2003 | Kamen et al. |
| 6,543,233 | B2 | 4/2003 | Young et al. |
| 6,553,767 | B2 | 4/2003 | Farmer et al. |
| 6,655,149 | B2 | 12/2003 | Farmer et al. |
| 6,705,081 | B2 | 3/2004 | Kamen et al. |
| 6,829,897 | B2 | 12/2004 | Moriya et al. |
| 6,854,258 | B2 | 2/2005 | Moriya et al. |
| 7,007,470 | B2 | 3/2006 | Langenfeld et al. |
| 7,111,460 | B2 | 9/2006 | Jensen et al. |
| 7,308,787 | B2 | 12/2007 | LaRocque et al. |
| 7,310,945 | B2 | 12/2007 | Gurski et al. |
| 7,373,772 | B2 | 5/2008 | Simons et al. |
| 7,654,084 | B2 | 2/2010 | Jensen et al. |
| 7,726,131 | B2 | 6/2010 | Sze et al. |
| 7,870,736 | B2 | 1/2011 | Homitz et al. |
| 7,934,926 | B2 | 5/2011 | Kornbluth et al. |
| 8,006,511 | B2 | 8/2011 | Kamen et al. |
| 8,028,529 | B2 | 10/2011 | Venkataraman et al. |
| 8,069,676 | B2 | 12/2011 | Kamen et al. |
| 8,176,739 | B2 | 5/2012 | Evulet et al. |
| 8,177,547 | B2 | 5/2012 | Kostlin et al. |
| 2002/0011070 | A1 | 1/2002 | Mandai et al. |
| 2005/0130089 | A1 | 6/2005 | Oda et al. |
| 2005/0268616 | A1 | 12/2005 | Widener |
| 2007/0137207 | A1 | 6/2007 | Mancini et al. |
| 2010/0263382 | A1 | 10/2010 | Mancini et al. |
| 2011/0225974 | A1* | 9/2011 | Khan et al. ..... 60/746 |
| 2012/0011855 | A1* | 1/2012 | Cai ..... F23N 1/00 60/773 |
| 2012/0285172 | A1* | 11/2012 | Poyyapakkam et al. ..... 60/737 |

FOREIGN PATENT DOCUMENTS

| | | |
|---|---|---|
| DE | 202010017464 | 1/2012 |
| EP | 1074792 | 2/2001 |
| EP | 2386797 | 11/2011 |
| WO | 0165100 | 9/2001 |

* cited by examiner

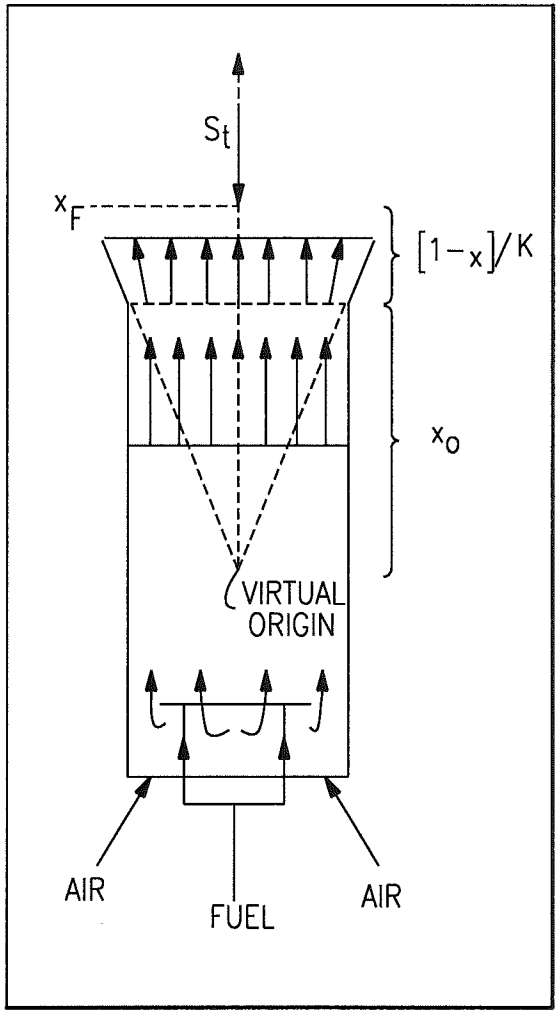

$$\frac{dM}{dx} = -\frac{M}{(1-M^2)}\,\frac{1+\frac{y-1}{2}M^2}{A}\,\frac{dA}{dx}$$

where: $M = \frac{U_o}{a}$

LOW MACH NO. ASSUMPTION LEADS TO $$\frac{1}{U_o}\frac{dU}{dx} = -\frac{1}{A}\frac{dA}{dx}$$

$$U_o - \delta U = S_t$$

$$U_o + \frac{dU}{dx}(x_F - x_o) = S_L(\Phi)(1+Cu')$$

LEADS TO $$x_F = x_o + \left[1 - \frac{S_L(\Phi)(1+Cu')}{U_o}\right] \Big/ \left(\frac{1}{A_o}\frac{dA}{dx}\right)$$

$$x_F = x_o + [1-x] \| K$$

where: $K = \frac{1}{A_o}\frac{dA}{dx}$ and $x = \frac{S_L(\Phi)(1+Cu')}{U_o}$

FIG.6

GAS TURBINE ENGINE COMBUSTOR

BACKGROUND

The present disclosure relates to a gas turbine engine combustor and, more particularly, to a "CUNERB" swirler assembly therefor.

Gas turbine engines, such as those which power commercial and military aircraft, include a compressor for pressurizing a supply of air, a combustor for burning a hydrocarbon fuel in the presence of the pressurized air, and a turbine for extracting energy from the resultant combustion gases. The combustor generally includes radially spaced apart inner and outer liners that define an annular combustion chamber therebetween. Arrays of circumferentially distributed combustion air holes penetrate multiple axial locations along each liner to radially admit the pressurized air into the combustion chamber. A plurality of circumferentially distributed fuel injectors axially project into a forward section of the combustion chamber to supply the fuel for mixing with the pressurized air.

Combustion of the hydrocarbon fuel in the presence of pressurized air may produce nitrogen oxide ($NO_X$) emissions that are subjected to excessively stringent controls by regulatory authorities, and thus may be sought to be minimized.

At least one known strategy to minimize $NO_X$ emissions is referred to as rich burn, quick quench, lean burn (RQL) combustion. The RQL strategy recognizes that the conditions for $NO_X$ formation are most favorable at elevated combustion flame temperatures, such as when a fuel-air ratio is at or near stoichiometric. A combustor configured for RQL combustion includes three serially arranged combustion zones: a rich burn zone at the forward end of the combustor, a quench or dilution zone axially aft of the rich burn zone, and a lean burn zone axially aft of the quench zone.

During engine operations, a portion of the pressurized air discharged from the compressor enters the rich burn zone of the combustion chamber. Concurrently, fuel injectors introduce a stoichiometrically excessive quantity of fuel into the rich burn zone. Although the resulting stoichiometrically fuel rich fuel-air mixture is ignited and burned to release the energy content of the fuel, some $NO_X$ formation may still occur.

The fuel rich combustion products then enter the quench zone where jets of pressurized air radially enter through combustion air holes into the quench zone of the combustion chamber. The pressurized air mixes with the combustion products to derich the fuel rich combustion products as they flow axially through the quench zone. The fuel-air ratio of the combustion products thereby changes from fuel rich to stoichiometric which may cause an attendant rise in combustion flame temperature. Since the quantity of $NO_X$ produced in a given time interval increases exponentially with flame temperature, quantities of $NO_X$ may be produced in this initial quench process. As the quenching continues, the fuel-air ratio of the combustion products changes from stoichiometric to fuel lean which cause an attendant reduction in the flame temperature. However, until the mixture is diluted to a fuel-air ratio substantially lower than stoichiometric, the flame temperature remains high enough to generate $NO_X$.

RQL injector designs operate on the principle of establishing a toroidal vortex followed by vortex break-down and the formation of a re-circulating zone to stabilize the flame and provide continuous ignition to the fresh reactants. This mode of operation results in relatively high shear stresses which, in turn, may lead to pressure oscillations from heterogeneous chemical release rates.

NOx formation is not only a function of temperature, but also of flame residence time and Oxygen concentration in the reaction zone. Increasing the flame strain tends to reduce the residence time in the flame, but may also increase the Oxygen concentration in the flame. These intermediate effects of strain rates tend to increase the production rate of NOx. At high strain rates, however, the reduction in flame temperature overcomes the influence of the Oxygen concentration, and NOx production rates are reduced.

Dry Low NOx (DLN) combustors utilize fuel-to-air lean premix strategy which operate near flame stability envelope limits where noise, flame blow-off (BO), and flashback may affect engine performance. For this reason, DLN strategy is limited to land-based Ground Turbine applications.

SUMMARY

A swirler for a combustor of a gas turbine engine according to one disclosed non-limiting embodiment of the present disclosure includes an inner injector, and an outer annular injector which at least partially surrounds the inner injector.

In a further embodiment of the foregoing embodiment, the inner injector is operable to generate a first swirl and the outer annular injector is operable to generate a second swirl, the first swirl different than the second swirl.

In a further embodiment of any of the foregoing embodiments, the inner injector is operable to generate a first swirl and the outer annular injector is operable to generate a second swirl, the first swirl greater than the second swirl.

In a further embodiment of any of the foregoing embodiments, the inner injector provides a one-dimensional swirl and the outer annular injector provides a three-dimensional swirl.

In a further embodiment of any of the foregoing embodiments, the swirler includes an annular recess tube within the outer annular injector. In the alternative or additionally thereto, in the foregoing embodiment the annular recess tube is upstream of an annular divergent exit.

In a further embodiment of any of the foregoing embodiments, the inner injector defines a convergent-divergent exit. In the alternative or additionally thereto, the foregoing embodiment includes an annular recess tube within the outer annular injector. In the alternative or additionally thereto, in the foregoing embodiment the annular recess tube is upstream of an annular divergent exit.

In a further embodiment of any of the foregoing embodiments, the inner injector defines a central passage and an inner annular passage radially outboard of the central passage.

In a further embodiment of any of the foregoing embodiments, the outer annular injector defines an outer annular passage radially outboard of the inner annular passage.

A combustor section for a gas turbine engine according to another disclosed non-limiting embodiment of the present disclosure includes an inner injector which defines an axis, an outer annular injector which surrounds the inner injector, and a combustor vane along the axis.

In a further embodiment of the foregoing embodiment, the combustor vane defines a length between 35%-65% of said combustion chamber.

In a further embodiment of any of the foregoing embodiments, the combustor section includes a combustor vane with a multiple of fuel injectors which flank the combustor vane.

In a further embodiment of any of the foregoing embodiments, the inner injector defines a central passage and an inner annular passage radially outboard of the central passage, the central passage includes convergent-divergent exit.

In the alternative or additionally thereto, in the foregoing embodiment the outer annular injector defines an outer annular passage radially outboard of the inner annular passage. In the alternative or additionally thereto, in the foregoing embodiment the inner injector selectively receives a fuel-air mixture. In the alternative or additionally thereto, in the foregoing embodiment the outer annular injector selectively receives a fuel-air mixture. In the alternative or additionally thereto, the foregoing embodiment includes an annular recess tube within the outer annular injector. In the alternative or additionally thereto, in the foregoing embodiment the inner annular passage selectively receives an airflow.

BRIEF DESCRIPTION OF THE DRAWINGS

Various features will become apparent to those skilled in the art from the following detailed description of the disclosed non-limiting embodiment. The drawings that accompany the detailed description can be briefly described as follows:

FIG. 6 is a mathematical relationship and associated schematic for the CUNERB swirler assembly;

DETAILED DESCRIPTION

Figure 1:
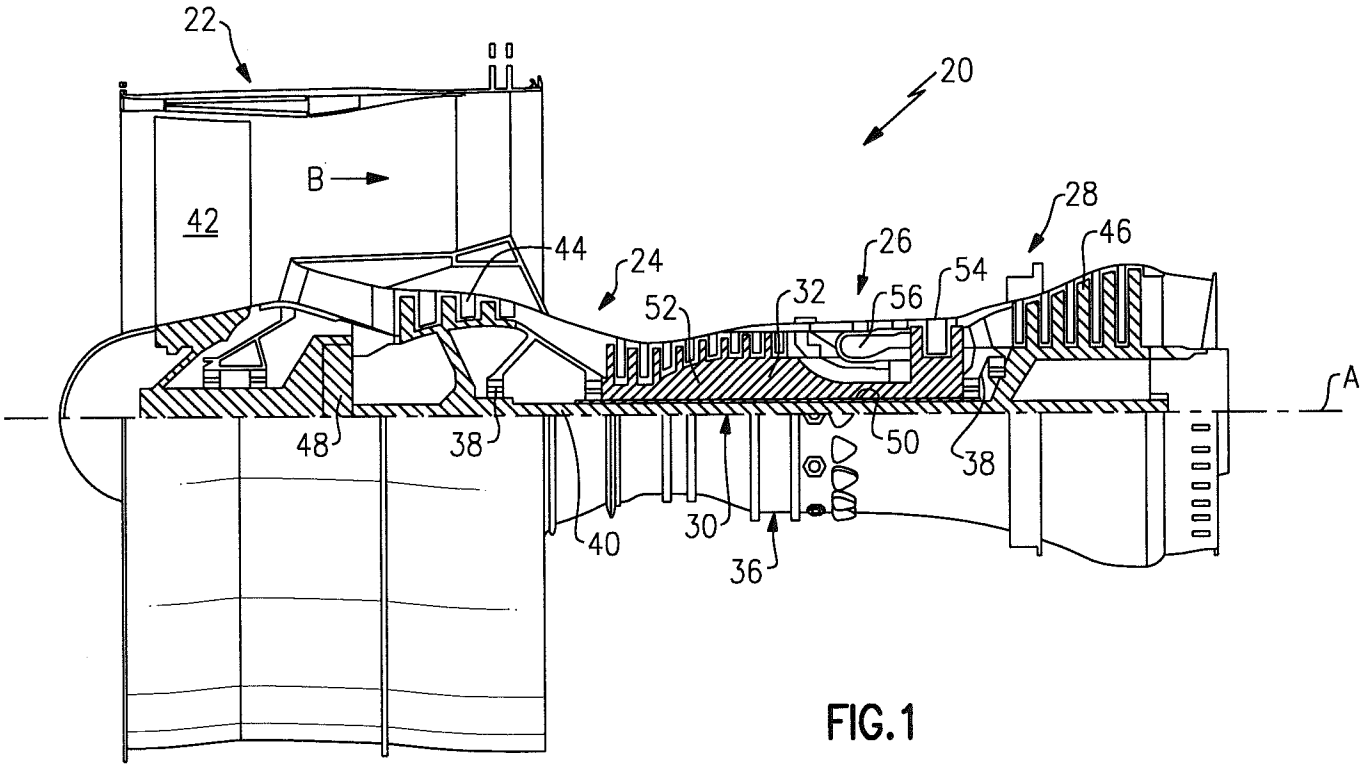
FIG. 1 is a schematic cross-section of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines such as a three-spool (plus fan) engine wherein an intermediate spool includes an intermediate pressure compressor (IPC) between the LPC and HPC and an intermediate pressure turbine (IPT) between the HPT and LPT.

The engine 20 generally includes a low spool 30 and a high spool 32 mounted for rotation about an engine central longitudinal axis A relative to an engine static structure 36 via several bearing structures 38. The low spool 30 generally includes an inner shaft 40 that interconnects a fan 42, a low pressure compressor 44 ("LPC") and a low pressure turbine 46 ("LPT"). The inner shaft 40 drives the fan 42 directly or through a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor 52 ("HPC") and high pressure turbine 54 ("HPT"). A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

Core airflow is compressed by the low pressure compressor 44 then the high pressure compressor 52, mixed with the fuel and burned in the combustor 56, then expanded over the high pressure turbine 54 and low pressure turbine 46. The turbines 54, 46 rotationally drive the respective low spool 30 and high spool 32 in response to the expansion.

The main engine shafts 40, 50 are supported at a plurality of points by bearing structures 38 within the static structure 36. It should be understood that various bearing structures 38 at various locations may alternatively or additionally be provided.

In one non-limiting example, the gas turbine engine 20 is a high-bypass geared aircraft engine. In a further example, the gas turbine engine 20 bypass ratio is greater than about six (6:1). The geared architecture 48 can include an epicyclic gear train, such as a planetary gear system or other gear system. The example epicyclic gear train has a gear reduction ratio of greater than about 2.3, and in another example is greater than about 2.5:1. The geared turbofan enables operation of the low spool 30 at higher speeds which can increase the operational efficiency of the low pressure compressor 44 and low pressure turbine 46 and render increased pressure in a fewer number of stages.

A pressure ratio associated with the low pressure turbine 46 is pressure measured prior to the inlet of the low pressure turbine 46 as related to the pressure at the outlet of the low pressure turbine 46 prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 44, and the low pressure turbine 46 has a pressure ratio that is greater than about 5 (5:1). It should be understood, however, that the above parameters are only exemplary of one embodiment of a geared architecture engine and that the present disclosure is applicable to other gas turbine engines including direct drive turbofans.

In one embodiment, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $(\text{"T"}/518.7)^{0.5}$ in which "T" represents the ambient temperature in degrees Rankine. The Low Corrected Fan Tip Speed according to one non-limiting embodiment of the example gas turbine engine 20 is less than about 1150 fps (351 m/s).

Figure 2:
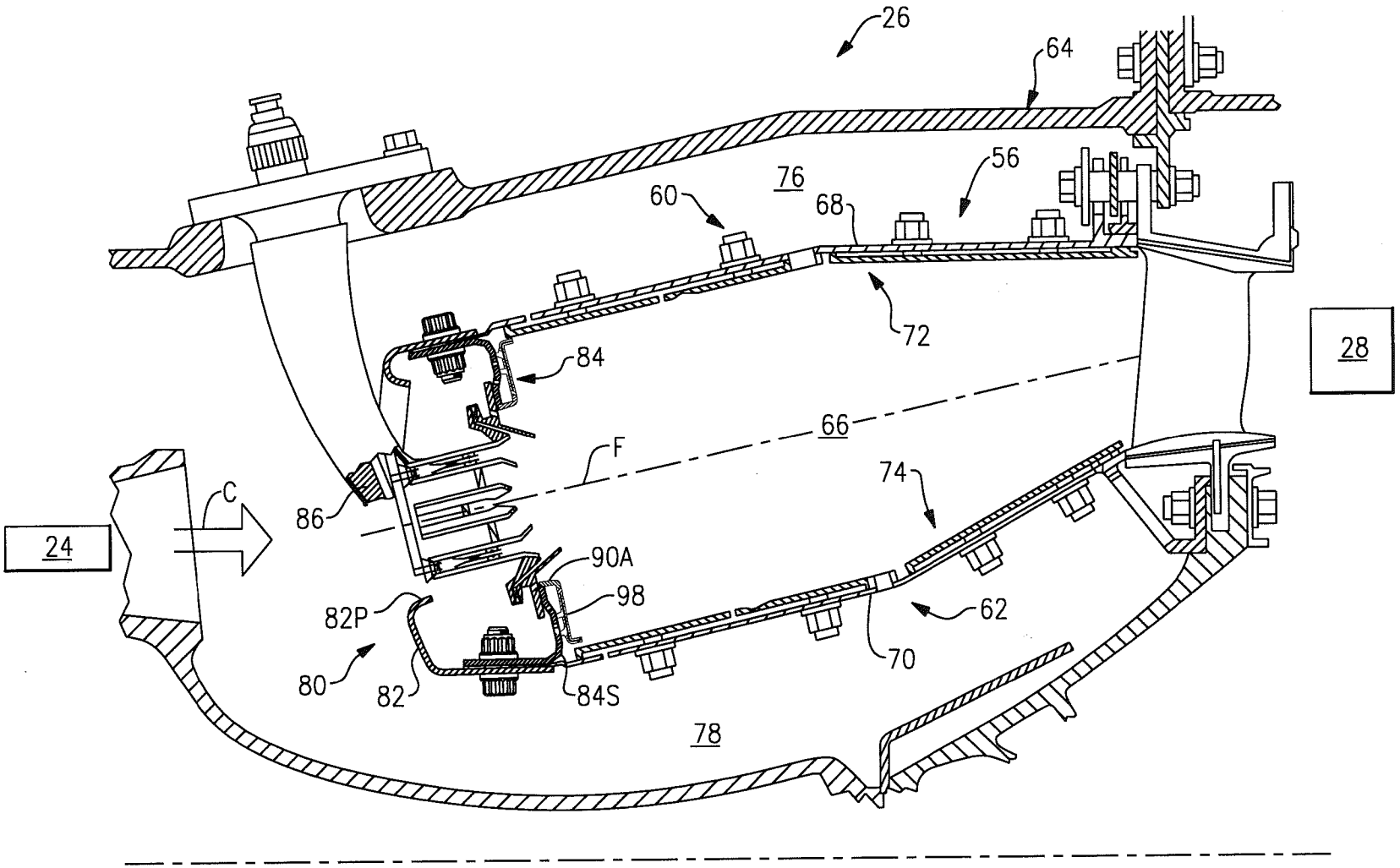
FIG. 2 is a partial longitudinal schematic sectional view of a combustor according to one non-limiting embodiment that may be used with the gas turbine engine shown in FIG. 1.

With reference to FIG. 2, the combustor 56 generally includes a combustor outer liner 60 and a combustor inner liner 62. The outer liner 60 and the inner liner 62 are spaced inward from a diffuser case 64 such that a combustion chamber 66 is defined therebetween. The combustion chamber 66 is generally annular in shape and is defined between combustor liners 60, 62.

The outer liner 60 and the diffuser case 64 define an outer annular plenum 76 and the inner liner 62 and the case 64 define an inner annular plenum 78. It should be understood that although a particular combustor arrangement is illustrated, other combustor arrangements will also benefit herefrom. Each liner 60, 62 generally includes a respective support shell 68, 70 that supports one or more respective liner panels 72, 74 mounted to a hot side of the respective support shell 68, 70. The liner panels 72, 74 define a liner panel array that may be generally annular in shape. Each of the liner panels 72, 74 may be generally rectilinear and manufactured of, for example, a nickel based super alloy or ceramic material.

The combustor 56 includes a forward assembly 80 immediately downstream of the compressor section 24 (illustrated schematically) to receive compressed airflow therefrom. The forward assembly 80 generally includes an annular hood 82, a bulkhead assembly 84, a fuel supply 86 (illustrated schematically) and a multiple of swirler assemblies 90 (one shown). The annular hood 82 extends radially between, and is secured to, the forwardmost ends of the liners 60, 62 and includes a multiple of circumferentially distributed hood ports 82P that direct compressed airflow into the forward end of the combustion chamber 66 through the swirler assemblies 90.

The bulkhead assembly 84 includes a bulkhead support shell 84S secured to the liners 60, 62, and a multiple of circumferentially distributed bulkhead heatshields segments 98 secured to the bulkhead support shell 84S around the central opening 90A. The forward assembly 80 directs a portion of the core airflow (illustrated schematically by arrow C) into the forward end of the combustion chamber 66 while the remainder may enter the outer annular plenum 76 and the inner annular plenum 78. The multiple of swirler assemblies 90 and associated fuel communication structure (illustrated schematically) supports combustion in the combustion chamber 66.

Figure 3:
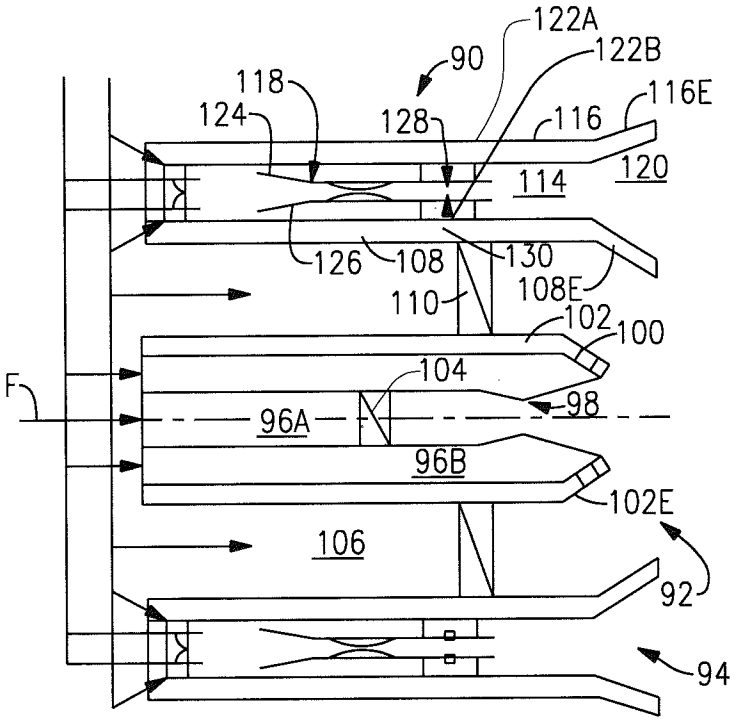
FIG. 3 is a partial longitudinal schematic sectional view of a CUNERB swirler assembly according to one non-limiting embodiment.

With reference to FIG. 3, the swirler assembly 90 generally includes an inner injector 92 and an outer annular injector 94 orchestrated together as one and referred to herein as a "CUNERB" swirler assembly. The inner injector 92 operates as a relatively high swirl injector and the outer annular injector 94 operates as a relatively low swirl injector. The inner injector 92 also generates a relatively one-dimensional swirl while the outer annular injector 94 generates a relatively three-dimensional swirl.

Figure 4:
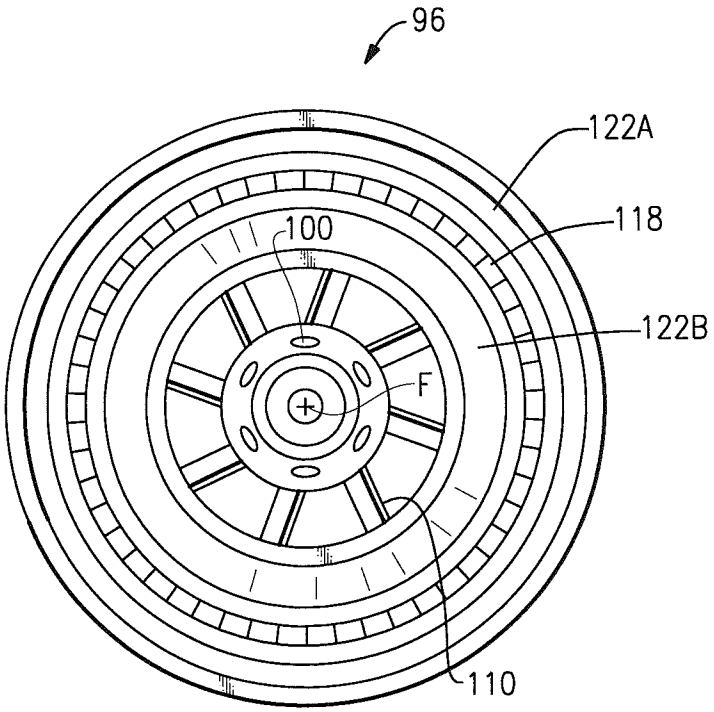
FIG. 4 is a front perspective view of the CUNERB swirler assembly of FIG. 3.

The inner injector 92 includes a central passage 96A, an annular central passage 96B, and an inner annular passage 106. The central passage 96A includes a convergent-divergent section 98 along a central axis F to control the flow split and to attain stable divergent core turbulent flow. Downstream of the convergent-divergent section 98, the annular central passage 96B communicates with a multiple of jets 100 (also shown in FIG. 4) that are located through a convergent distal end 102E of a central passage wall 102 to promote a desired degree of turbulence intensity. The convergent distal converges toward axis F. The central passage 96A may include a multiple of central vanes 104 which facilitate generation of spin to the fuel.

The inner annular passage 106 is radially outboard of the central passage wall 102. The inner annular passage 106 is radially outward bounded by an inner annular wall 108 which includes an inner wall distal end 108E that converges toward the central passage 96A. A multiple of inner annular passage vanes 110 may be located between the central passage wall 102 and the inner wall 108 to provide structural support therebetween. The multiple of inner annular passage vanes 110 may also be utilized to direct or spin the compressed airflow which flows through the inner annular passage 106. That is, the central passage 96A and annular central passage 96B communicates fuel, whereas, the inner annular passage 106 therearound communicates airflow.

The outer annular injector 94 includes an outer annular passage 114 radially outboard of the inner annular passage 106. An outer wall 116 bounds the outer annular passage 114. The outer annular passage 114 includes an annular recess tube 118 to stabilize the flow and facilitate a desired velocity profile and rotation to settle the flame at a desired location beyond a divergent exit 120 defined by an outer wall distal end 116E of the outer wall 116 and the distal end 108E of the inner annular wall 108.

Figure 5:
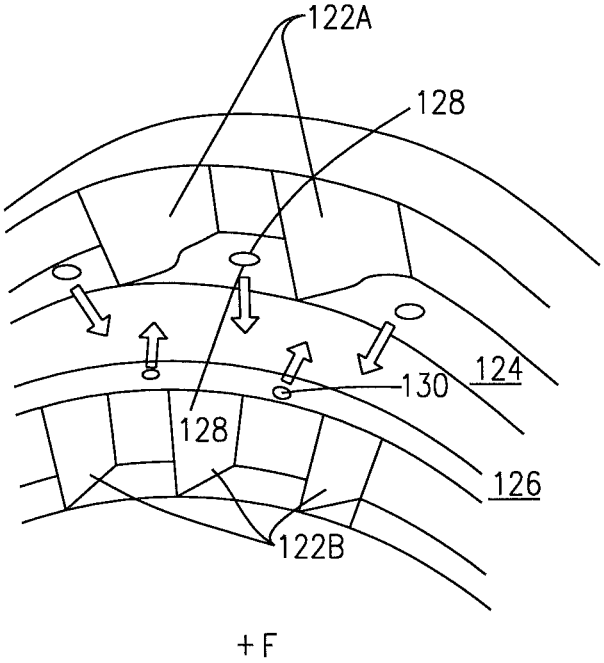
FIG. 5 is an expanded front perspective view of a recessed tube of the CUNERB swirler assembly of FIG. 3.
Figure 7:
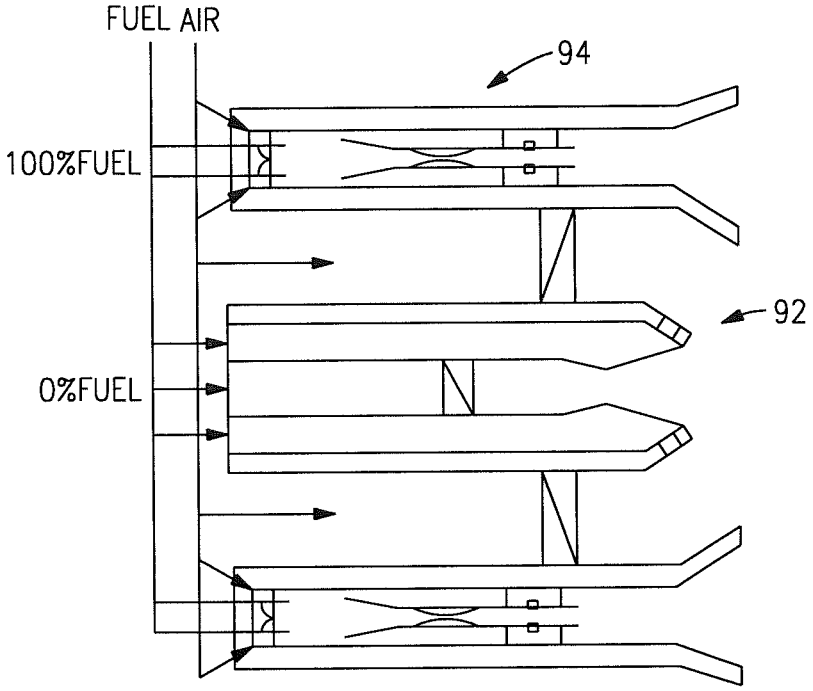
FIG. 7 is a partial longitudinal schematic sectional view of the CUNERB swirler assembly in a "Start-Up" mode.

The annular recess tube 118 is supported by a multiple of inner and outer support vanes 122A, 122B. An outer wall 124 and an inner wall 126 of the annular recess tube 118 includes a respective multiple of apertures 128, 130 located between the respective support vanes 122A, 122B (FIG. 5). The respective multiple of apertures 128, 130 are circumferentially offset to induce a swirl in the annular recess tube 118 and thus from the outer annular passage 114 of the outer annular injector 94. The outer annular injector 94 thereby generates a swirled fuel-air mixture therefrom.

Figure 8:
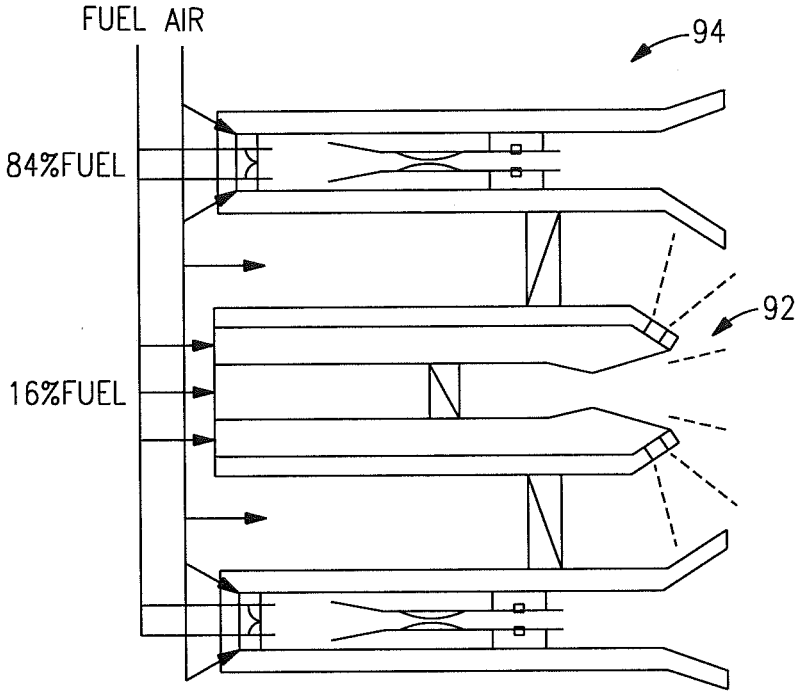
FIG. 8 is a partial longitudinal schematic sectional view of the CUNERB swirler assembly in a "Low Power" mode.
Figure 9:
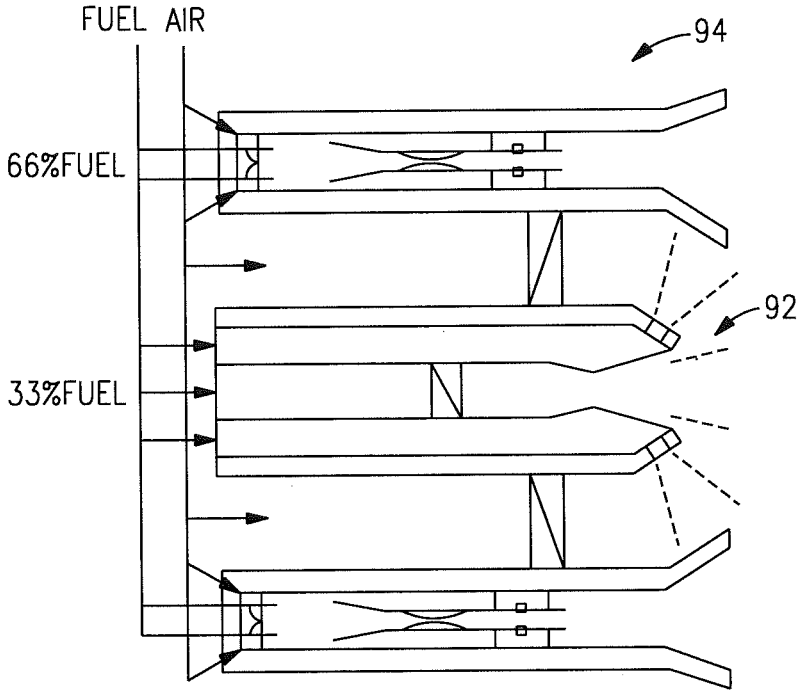
FIG. 9 is a partial longitudinal schematic sectional view of the CUNERB swirler assembly in a "High Power" mode.
Figure 10:
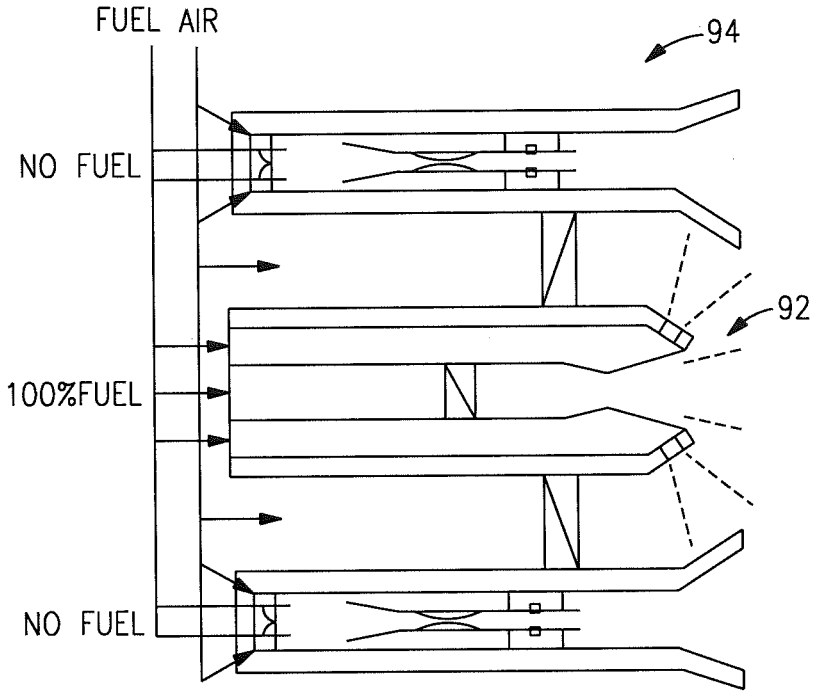
FIG. 10 is a partial longitudinal schematic sectional view of the CUNERB swirler assembly in a "Transient" mode.

The outer injector 114 of the combustor 56 operates on the principle of matching fluid velocity, U, from the injector to the flame speed, S, towards the injector so that the flame is fixed (anchored) or controlled in space relative to a virtual origin; FIG. 6. This control is achieved through the deceleration of the flow in the outer annular injector 94, whose derivation is shown schematically in FIG. 6, leading to the following governing equation [1]:

$$x_F = x_0 + [1 - \chi]/K \quad [1]$$

Where with the corresponding nomenclature for the symbols appearing in FIG. 6 as:

A~cross sectional area
a~sonic speed
C~constant
dA~differential area
dx~differential distance
dM~Mach No. change
M~Mach No.
S~flame speed
u'~turbulent component of axial velocity
U~axial velocity x~axial distance
γ~specific heat ratio
δ~denotes change
φ~equivalence ratio
- Subscripts
F~final
O~initial
L~laminar
T~turbulent With reference to FIGS. 7-10, operating modes at Start-Up; Low Power; Transient; and High Power are schematically illustrated. At Start-Up (FIG. 7), 100% of the fuel is supplied to the outer annular injector 94. At Low Power (FIG. 8), approximately 16% of the fuel is supplied to the inner injector 92 and approximately 84% is provided to the outer annular injector 94. At High Power (FIG. 9), approximately 33% of the fuel is supplied to the inner injector 92 and approximately 66% is provided to the outer annular injector 94 to reduce NOx formation where low swirl combustion NOx formation is many times less than that of a high swirl combustion. During transient (FIG. 10), in which the engine 20 is throttled toward the Low Power flight mode, 100% of fuel is supplied to the inner injector 92, followed by fuel increase to the outer annular injector 94 until as shown in the Low Power mode (FIG. 8).

The combustor 56 provides 2.5-5 times lower NOx formation and facilitates flame stability in comparison to lean premixed combustors with higher adiabatic flame temperatures and less propensity for combustion pressure oscillations. During high power flight conditions, the low swirl outer annular injector 94 complements the robustness of the high swirl inner injector 92. During low power flight conditions, flame is generated from the inner injector 92 while the low swirl outer annular injector 94 operate as premixed chambers.

Figure 11:
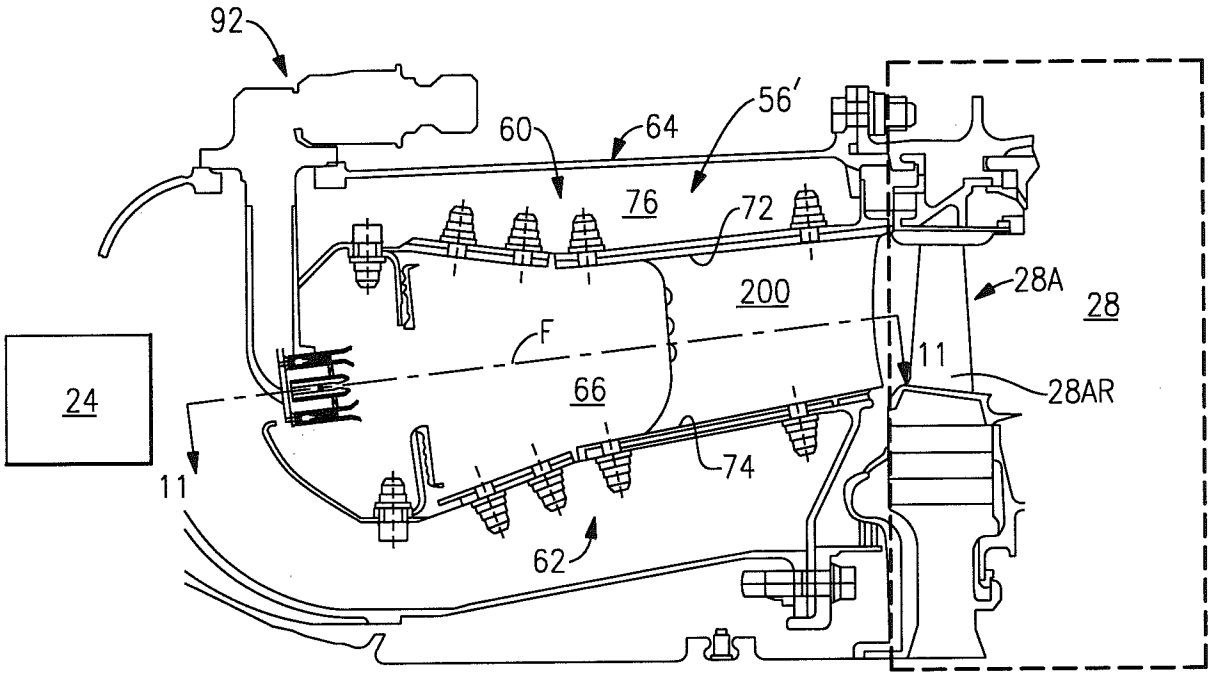
FIG. 11 is a partial longitudinal schematic sectional view of a combustor with combustor vanes according to another non-limiting embodiment that may be used with the gas turbine engine shown in FIG. 1.

With reference to FIG. 11, the combustor 56' may further include a multiple combustor vanes 200 integrated into the combustor 56' between the liner panels 72, 74 of respective liners 60, 62 according to another non-limiting embodiment. The combustor vanes 200 extends at least partially into the combustion chamber 66—the primary zone to perform combustor dilution/mixing requirements—such that a turbine rotor assembly 28A is the first stage immediately downstream of the combustor 56'. That is, no first stage vane such as nozzle guide vanes are required immediately downstream of the combustor 56 as the combustor vanes 200 provide the performance characteristics of a turbine first stage vane in terms of turbine flow metering and compressor cycle matching. In one disclosed, non-limiting embodiment the combustor vanes 200 define an axial length between 35%-65% of the combustion chamber 66. Moreover, the combustor vanes 200 may be positioned to block hot streaks from progressing into the turbine section 28. For further understanding of other aspects of the integrated combustor vane and associated operational modes thereof, attention is directed to U.S. patent application Ser. Nos. 13/627,722 and 13/627,697 both filed on Sep. 26, 2012, each entitled GAS TURBINE ENGINE COMBUSTOR WITH INTEGRATED COMBUSTOR VANE and which are assigned to the assignee of the instant disclosure and which is hereby incorporated herein in its entirety.

Figure 12:
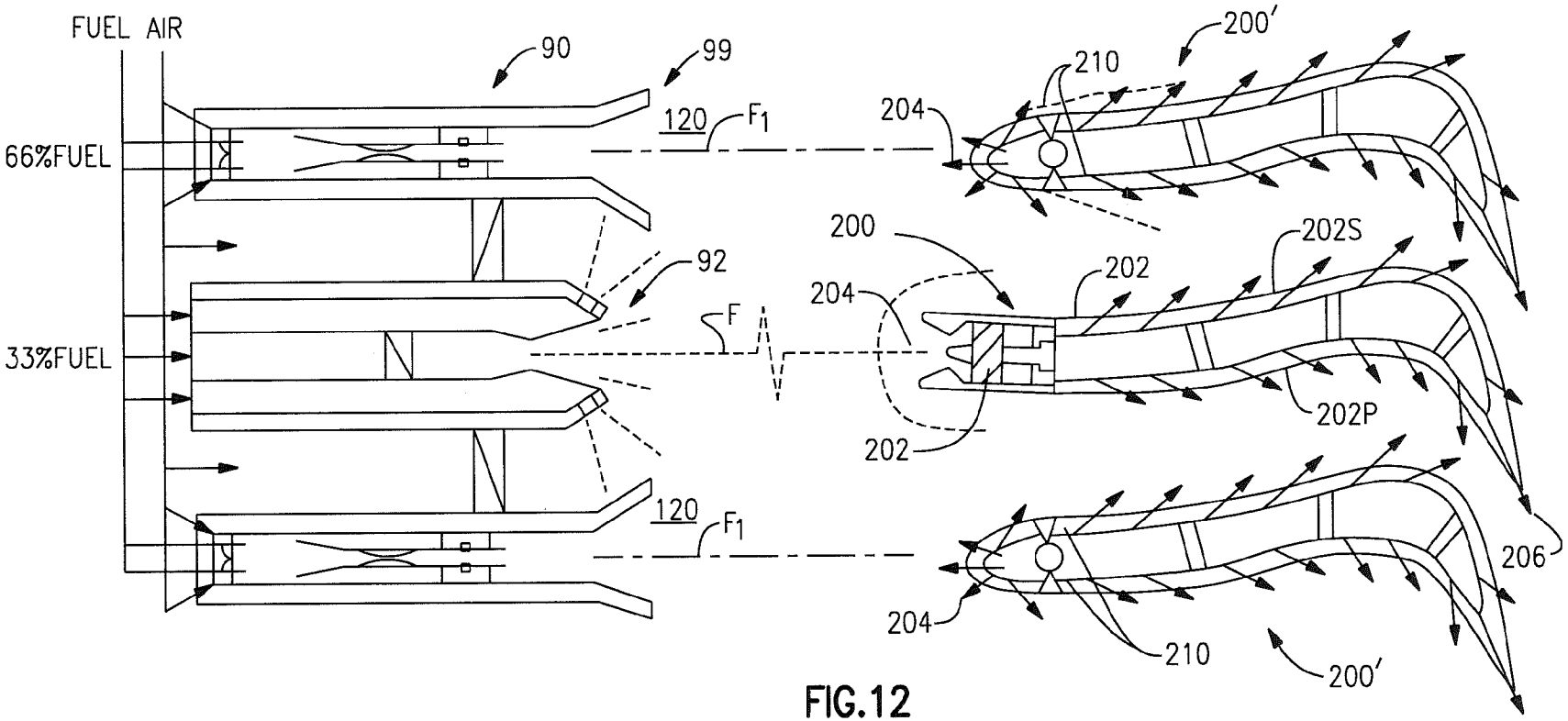
FIG. 12 is a sectional view taken along line 11-11 in FIG. 11.

With reference to FIG. 12, each combustor vane 200 may be located directly axially downstream of the inner injector 92 along axis F. That is, the leading edge swirlers 202 face the inner injector 92 along axis F. The combustor vanes 200 facilitate a decrease in the overall length of the combustor section 26 and thereby the engine 20 as a result of improved mixing in the combustion chamber 66, and by elimination of conventional dilution holes and the elimination of a separate first stage turbine vane (e.g., nozzle guide vane) of the turbine section 28.

Each combustor vane 200 is defined by an outer airfoil wall surface 202 between a leading edge 204 and a trailing edge 206. The outer airfoil wall surface 202 defines a generally concave shaped portion forming a pressure side 202P and a generally convex shaped portion forming a suction side 202S. A fillet may be located between the airfoil wall surface 202 and the adjacent generally planar liner panels 72, 74 (FIG. 11).

A combustor vane 200' with a multiple of fuel injectors 210 flank each combustor vane 200 axially downstream of the outer injector 94 along respective axis F1 to facilitate further combustion. That is, the combustor vanes 200' face the divergent exit 120 along axis F1. The combustor vanes 200' are spaced from the combustor vane 200 axis F by a distance which is equivalent to the radius from axis F to axis F1.

The fuel injectors 210 from combustor vane 200' provide a divergent fuel flow spray for further combustion in the secondary stage. The fuels injectors 210 may be located downstream of a leading edge 204 of each combustor vane 200' on both a compression and an expansion side. It should be appreciated that various arrangements, numbers, sizes, and patterns may alternatively or additionally be provided.

Figure 13:
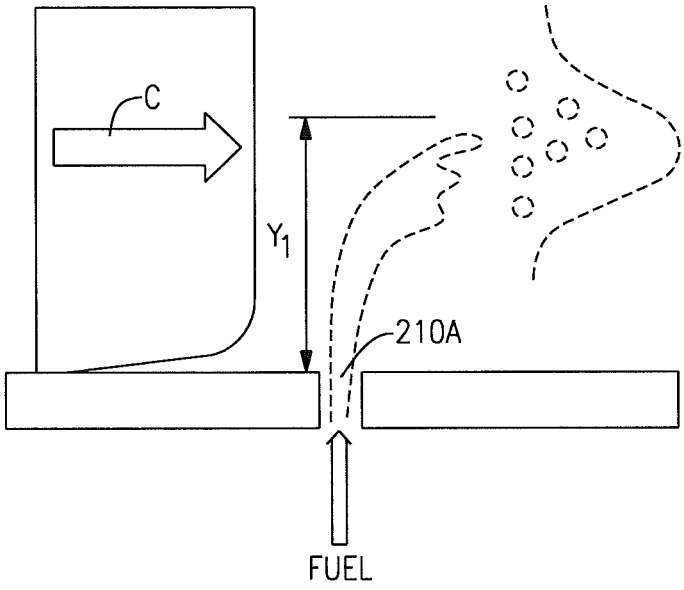
FIG. 13 is a schematic view of a fuel injector for the combustor vanes according to one non-limiting embodiment.
Figure 14:
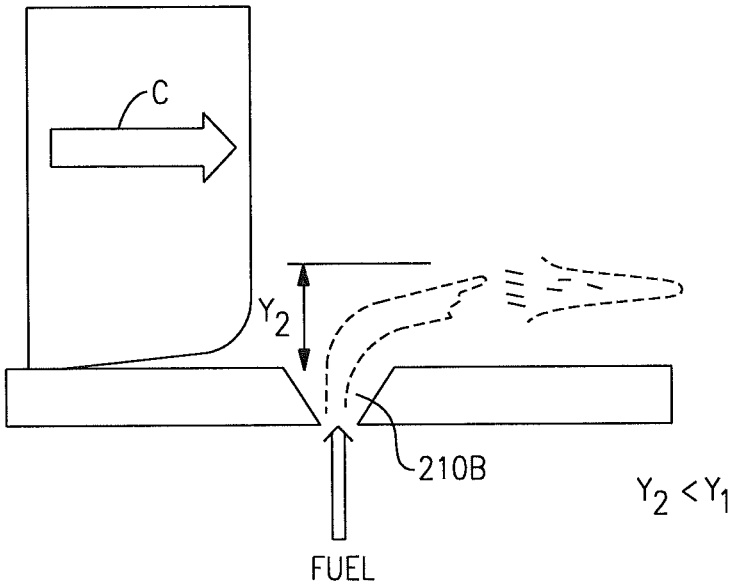
FIG. 14 is a schematic view of a fuel injector for the combustor vanes according to another non-limiting embodiment.

In one disclosed non-limiting embodiment, the fuel injectors 210A are rectilinear (FIG. 13). In another disclosed non-limiting embodiment, the fuel injectors 210B are conical (FIG. 14). The results of several tests conducted on side wall combustion found that the conical injectors 210B provide a more controlled combustion close to the combustor vane walls 202' due to lower degree of fuel penetration distance Y1 (FIG. 13) vs. distance Y2 (FIG. 14).

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A swirler for a combustor of a gas turbine engine comprising:

an inner injector;

an outer annular injector which at least partially surrounds said inner injector; and an annular recess tube within said outer annular injector, wherein the outer annular injector includes an outer annular passage radially outboard of an inner annular passage of the inner injector, wherein an outer wall bounds the outer annular passage, wherein the annular recess tube is contained within the outer wall and an inner annular wall that bounds the inner annular passage, and wherein vanes are located in the inner annular passage; and wherein the outer wall and the inner annular wall are configured to diverge from one another at an exit end of the outer annular passage, and wherein said annular recess tube is disposed upstream of the exit end of the outer annular passage and upstream of an exit end of the inner injector.

2. The swirler as recited in claim 1, wherein said inner injector is operable to generate a first swirl and said outer annular injector is operable to generate a second swirl, said first swirl different than said second swirl.

3. The swirler as recited in claim 1, wherein said inner injector is operable to generate a first swirl and said outer annular injector is operable to generate a second swirl, said first swirl greater than said second swirl.

4. The swirler as recited in claim 1, wherein said inner injector provides a one-dimensional swirl and said outer annular injector provides a three-dimensional swirl.

5. The swirler as recited in claim 1, wherein said inner injector defines a convergent-divergent exit.

6. The swirler as recited in claim 1, wherein said inner injector defines a central passage and the inner annular passage is radially outboard of said central passage.

7. The swirler as recited in claim 1, wherein the annular recess tube is configured to settle a flame at a location beyond a divergent exit defined by an outer wall distal end of the outer wall and a distal end of the inner annular wall.

8. The swirler as recited in claim 1, wherein the annular recess tube is oriented substantially along a central longitudinal axis of the outer annular injector.

9. The swirler as recited in claim 1, wherein the inner injector includes a central passage and an annular central passage radially outboard of said central passage, and wherein the inner annular passage is radially outboard of said annular central passage, and wherein the central passage and the annular central passage are configured to communicate fuel, and wherein the inner annular passage is configured to communicate an airflow.

10. The swirler as recited in claim 9, wherein the annular central passage communicates with a multiple of jets to promote a degree of turbulence intensity.

11. The swirler as recited in claim 1, wherein an outer wall of the annular recess tube includes a first multiple of apertures, and wherein an inner wall of the annular recess tube includes a second multiple of apertures, and wherein the first and second apertures are circumferentially offset to induce a swirl in the annular recess tube and from the outer annular passage.

12. A combustor section for a gas turbine engine comprising:

an inner injector which defines an axis;

an outer annular injector which surrounds said inner injector;

a combustor vane along said axis; and an annular recess tube within said outer annular injector, wherein the outer annular injector includes an outer annular passage radially outboard of an inner annular passage of the inner injector, wherein an outer wall bounds the outer annular passage, wherein the annular recess tube is contained within the outer wall and an inner annular wall that bounds the inner annular passage, and wherein vanes are located in the inner annular passage; and wherein the outer wall and the inner annular wall are configured to diverge from one another at an exit end of the outer annular passage, and wherein said annular recess tube is disposed upstream of the exit end of the outer annular passage and upstream of an exit end of the inner injector.

13. The combustor section as recited in claim 12, wherein said combustor vane defines a length between 35%-65% of said combustor section.

14. The combustor section as recited in claim 12, further comprising a multiple of fuel injectors which flank said combustor vane.

15. The combustor section as recited in claim 12, wherein said inner injector defines a central passage and the inner annular passage is radially outboard of said central passage, said central passage includes a convergent-divergent exit.

16. The combustor section as recited in claim 12, wherein said inner injector selectively receives a fuel-air mixture.

17. The combustor section as recited in claim 12, wherein said outer annular injector selectively receives a fuel-air mixture.

18. The combustor section as recited in claim 15, wherein said inner annular passage selectively receives an airflow.

19. The combustor section as recited in claim 12, wherein said inner injector provides a one-dimensional swirl and said outer annular injector provides a three-dimensional swirl.

* * * * *